US006739452B2

(12) United States Patent
Rochelo

(10) Patent No.: US 6,739,452 B2
(45) Date of Patent: May 25, 2004

(54) MEMORY DEVICE PROTECTIVE CONTAINER

(76) Inventor: Donald R. Rochelo, 66 Leona Dr., Pittsfield, MA (US) 01201

( * ) Notice: Subject to any disclaimer, the term of this patent is extended or adjusted under 35 U.S.C. 154(b) by 0 days.

(21) Appl. No.: 10/256,372

(22) Filed: Sep. 27, 2002

(65) Prior Publication Data

US 2003/0062275 A1 Apr. 3, 2003

Related U.S. Application Data

(60) Provisional application No. 60/326,290, filed on Oct. 1, 2001.

(51) Int. Cl.[7] ..... B69D 85/48
(52) U.S. Cl. ..... 206/454; 206/591
(58) Field of Search ..... 206/449, 308.1, 206/454, 521, 591, 592, 594, 372, 373; 220/521, 528

(56) References Cited

U.S. PATENT DOCUMENTS 3,615,006 A * 10/1971 Freed ..... 206/454
3,999,661 A * 12/1976 Jones ..... 206/591
4,741,441 A * 5/1988 Keffeler ..... 206/532
5,183,159 A * 2/1993 Hojnacki et al. ..... 206/583
5,526,929 A * 6/1996 Wei ..... 206/378
5,826,719 A * 10/1998 Chen ..... 206/373
6,230,885 B1 5/2001 Rochelo et al.

* cited by examiner

*Primary Examiner*—Shian Luong
(74) *Attorney, Agent, or Firm*—Malcolm J. Chisholm, Jr.

(57) ABSTRACT

A memory device protective carrier is disclosed for protecting small memory devices. The container includes a non-deformable, rigid exterior case having first and second shells and a securing mechanism to adjustably secure the shells in an open or closed position so that a containment chamber is defined between the shells in the closed position. A deformable, resilient receiving insert and a resilient securing insert are secured respectively within the first and second shells. Sealing lips of the inserts are compressed in the closed position to form a fluid seal so that a memory device secured within the containment chamber is protected by the rigid case and resilient inserts against damage from impact injury or fluid contaminants.

15 Claims, 2 Drawing Sheets

MEMORY DEVICE PROTECTIVE CONTAINER

CROSS REFERENCE TO RELATED APPLICATION

This Application claims the benefit of U.S. Provisional Patent Application Serial No. 60/326,290 filed on Oct. 1, 2001.

TECHNICAL FIELD

The present invention relates to containers for memory devices, and in particular relates to a device that both contains and protects memory devices.

BACKGROUND OF THE INVENTION

It is well known that memory devices for storage of data for modern electronic components, such as computers, cameras, entertainment systems, etc., are becoming increasingly smaller. For example, solid memory technology currently and commonly referred to in the art as "miniature hard drives", "flash memories", "SONY" brand name "memory sticks" may be readily secured in containers as small as two inches in length and width and one-half inch in depth. Such small memory devices provide substantial conveniences in storing, backing-up and transferring data such as computer programs, visual images, audio data, etc. Because such memory devices are so small, however, they also give rise to significant risks related to transport of the devices. For example, dropping of the devices could damage them, exposure to moisture could likewise injure them, or contact of data transfer ports of the devices with foreign objects could also harm them.

It is known that some modern protective carriers exist for solid memory devices, such as a memory card protective carrier disclosed in U.S. Pat. No. 6,230,885 that issued on May 15, 2001 to the owners of all rights in the invention described herein, which patent in hereby incorporated herein by reference. The memory card protective carrier disclosed therein provides for a protective band to overlie data transfer ports of the memory card whenever the card is secured within the carrier. However, neither that carrier nor any known memory device protective carrier provides for adequate protection of a memory device against impact damage resulting from dropping the carrier, or from moisture contamination from liquid or vapor fluid contaminants. Additionally, known carriers for small memory devices are typically made of a hard plastic that is very slippery, such as well known audio cassette and "VHS" format video tape plastic containers. It is well known that such containers are slippery to physically handle and that they frequently slide off of counter tops and tables in minor accidents, and are thereby frequently damaged upon impact with a floor.

Accordingly, there is a need for a memory device protective container that provides protection for memory devices against damage from an unintended impact and from fluid contaminants.

SUMMARY OF THE INVENTION

The invention is a memory device protective container for containing and protecting a memory device. The container includes a rigid exterior case having a first shell that defines a first peripheral edge, having a second shell that defines a second peripheral edge, and having a securing mechanism for adjustably securing the first and second peripheral edges from an open position to a closed position wherein the edges are adjacent each other to define a containment chamber between the first and second shells. A resilient receiving insert is dimensioned to nest within the first shell, and the resilient receiving insert defines a first sealing peripheral lip that is positioned adjacent to the first peripheral edge of the first shell whenever the resilient receiving insert nests within the first shell. The resilient receiving insert also defines a first base extending between the first sealing peripheral lip. The first base has at least one first flared tongue extending away from a shell contact surface of the first base and the flared tongue is dimensioned to pass through and be secured by a first tongue slot defined within the first shell. The resilient receiving insert also defines one or more receiving posts extending from a side of the first base opposed to the shell contact surface into the containment chamber. The flexible receiving posts are positioned to receive and secure the memory device between the posts.

A resilient securing insert is dimensioned to nest within the second shell, and the resilient securing insert defines a second sealing peripheral lip that is positioned adjacent to the second peripheral edge of the second shell whenever the resilient securing insert nests within the second shell. The resilient securing insert also defines a second base extending between the second sealing peripheral lip and the second base has at least one second flared tongue extending from a shell contact surface of the second base that is dimensioned to pass through and be secured by a second tongue slot defined within the second shell. The resilient securing insert also defines at least one securing rib extending from a side of the second base opposed to the shell contact surface into the containment chamber between the inserts. The securing rib is positioned and dimensioned to pass between the flexible posts of the resilient receiving insert to secure the memory device against movement within the containment chamber whenever the first and second peripheral edges of the first and second shells are positioned adjacent each other.

The rigid exterior case provides durability to the container and also provides a firm structure to support the soft, resilient inserts so that the memory device is protected against any damage resulting from an impact upon the rigid exterior case. In a preferred embodiment, the flared tongues of the inserts extend through the tongue slots defined within the first and second shells a distance beyond an exterior surface of the shells so that the soft, resilient flared tongues provide enhanced friction to the exterior case thereby further reducing a risk of accidental impact damage to the memory device secured within the containment chamber. In an additional preferred embodiment, the first sealing peripheral lip and second sealing peripheral lip are cooperatively dimensioned to contact and compress against each other to form a fluid seal restricting fluid movement into or out of the containment chamber whenever the securing mechanism secures the first and second peripheral edges of the first and second shells adjacent each other.

In a further embodiment, the resilient receiving insert may also include at least one support ridge extending from the first base between the flexible receiving posts into the containment chamber to restrict smooth surface contact between the memory device and the first base of the resilient receiving insert. By restricting smooth surface contact between the first base and the memory device, any possible contamination by moisture or a foreign object is minimized. Additionally, because the support ridge raises the memory device away from contact with the first base, extraction of the memory device by the fingers of a user is facilitated.

Accordingly, it is a general object of the present invention to provide a memory device protective container that overcomes the deficiencies of prior art containers.

It is a more specific object to provide a memory device protective container that facilitates containment, ease of access, and protection of memory devices within the container.

It is yet another object to provide a memory device protective container that protects memory devices within the container against contamination from fluids.

It is a further object to provide a memory device protective container that enhances friction of an exterior case of the container.

These and other objects and advantages of the present memory device protective container invention will become more readily apparent when the following description is read in conjunction with the accompanying drawings.

DESCRIPTION OF THE PREFERRED EMBODIMENTS

Figure 1:
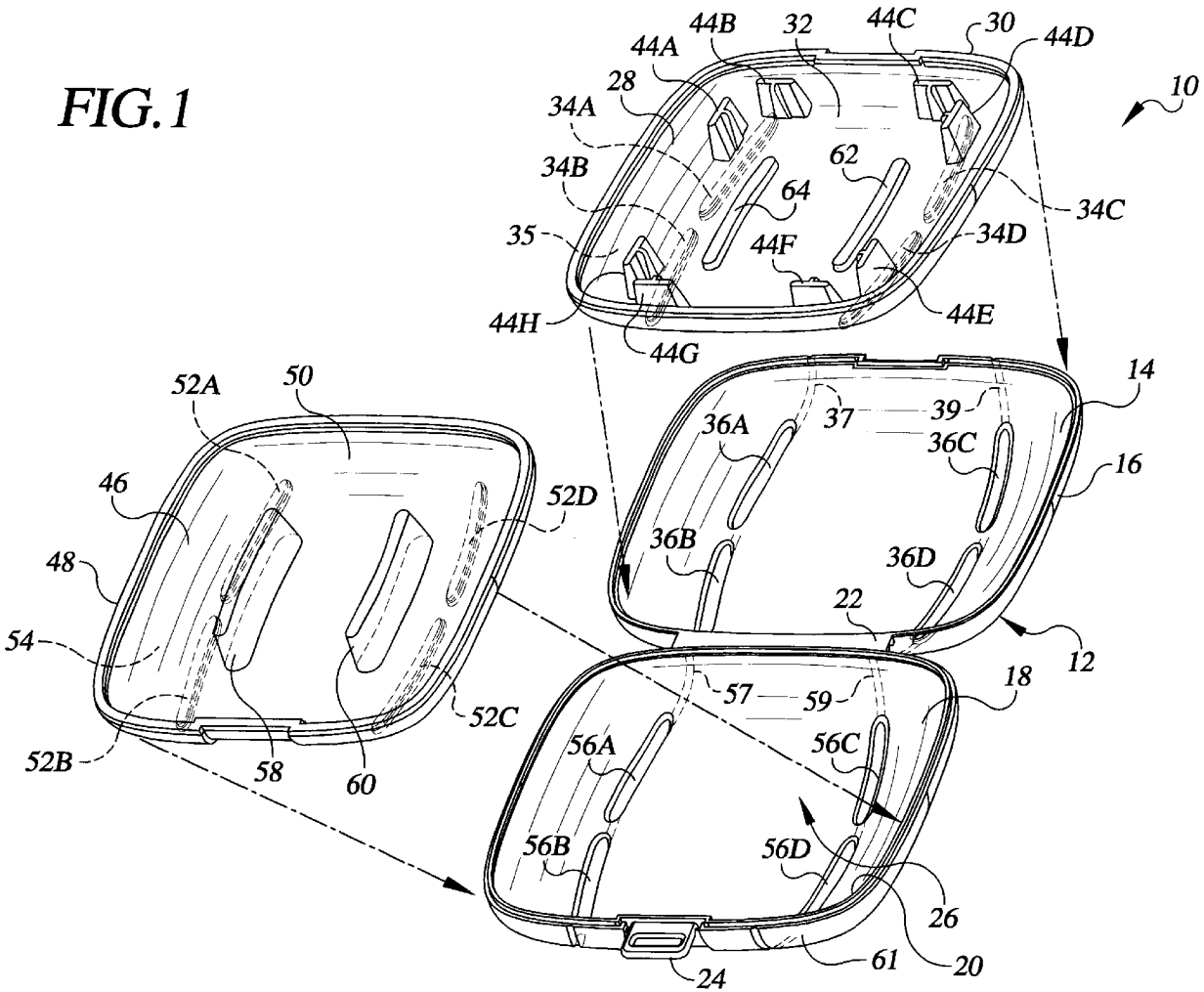
FIG. 1 is an exploded, perspective view of a memory device protective container constructed in accordance with the present invention showing a resilient securing insert and a resilient receiving insert above a rigid exterior case in an open position.
Figure 2:
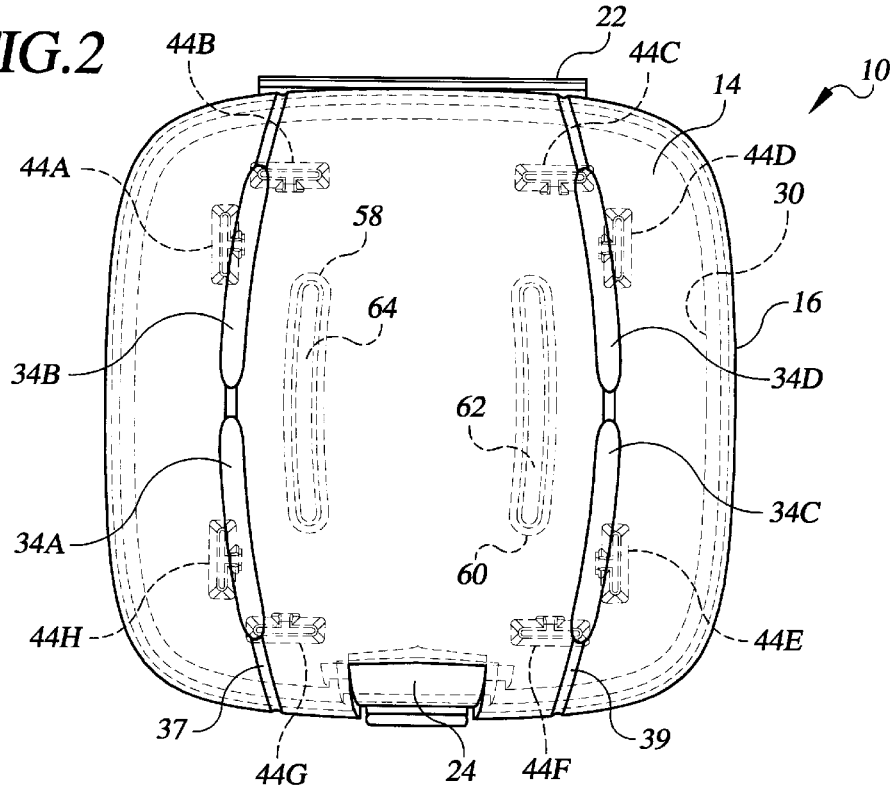
FIG. 2 is a top plan view of a memory device protective container in a closed position.
Figure 3:
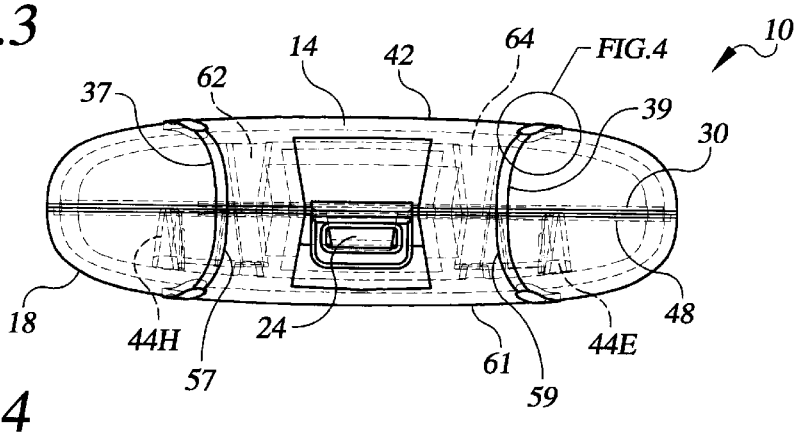
FIG. 3 is a front plan view of the FIG. 2 memory device protective container.

Referring to the drawings in detail, a memory device protective container of the present invention is shown in FIGS. 1–3, and is generally designated by the reference numeral 10. As seen in FIG. 1, the memory device protective container 10 includes a rigid exterior case 12 having first shell 14. The first shell 14 includes a first peripheral edge 16 that surrounds the first shell 14. The rigid exterior case 12 also includes a second shell 18 having a second peripheral edge 20 that surrounds the second shell 18.

The rigid case 12 also includes a securing means for adjustably securing the first and second shells 14, 18 from an open position as shown in FIG. 1 to a closed position as shown in FIGS. 2 and 3, wherein the first peripheral edge 16 and second peripheral edge 20 are adjacent each other. The securing means may include a standard hinge 22 secured between the first shell 14 and second shell 18 and a standard latch 24 secured to the first or second peripheral edge 16, 20 at a position opposed to the hinge 22. The securing means may also include a sealing hinge, wherein a first hinge-half (not shown) is flush with the first or second peripheral edge 16, 20, and an opposed second hinge half (not shown) is not flush with the opposed peripheral edge to enhance a tight seal between the first and second peripheral edges, or the hinge halves are otherwise secured and manufactured of plastic so that the plastic develops no memory to force the two peripheral edges out of being secured adjacent to each other. It is to be understood that the scope of the present invention includes any known securing means that may adjustably secure the rigid exterior case 12 between an open and a closed position, such as standard compression activated latches, snap-fit latches, etc. As shown in FIG. 1, the first and second shells 14, 18 are cup-shaped so that they define a containment chamber 26 between the shells 14, 18 whenever they are in a closed position.

The memory device protective container 10 also includes a resilient receiving insert 28 that is dimensioned to nest within the first shell 14, and the resilient receiving insert 28 defines a first sealing peripheral lip 30 that surrounds the insert 26, and is positioned adjacent to the first peripheral edge 16 of the first shell 14 whenever the resilient receiving insert nests within the first shell 14. The resilient receiving insert 28 also defines a first base 32 extending between the first sealing peripheral lip 30. The first base has a plurality of first flared tongues 34A, 34B, 34C, 34D that extend away from a shell contact surface 35 of the first base 32, and the flared tongues 34A, 34B, 34C, 34D are dimensioned to pass through and be secured within a corresponding plurality of first tongue slots 36A, 36B, 36C, 36D defined within the first shell 14.

Figure 4:
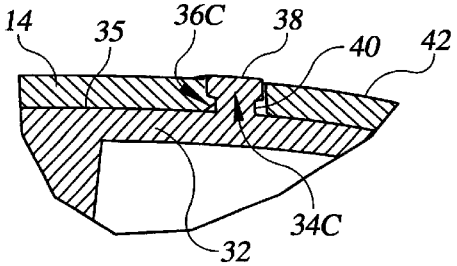
FIG. 4 is a fragmentary, cross-sectional view of a flared tongue secured within a tongue slot of a first shell of the FIG. 2 memory device protective container.

As best seen in FIG. 4 with respect to one of the plurality of first flared tongues 34C, all of the flared tongues 34A, 34B, 34C, 34D, may include a contact head 38 like that of 34C that is wider than a stem 40 of the tongue, wherein the contact head is dimensioned to be wider than the tongue slot 36C to assist in securing the resilient receiving insert 28 within the first shell 14. Additionally, the contact head 38 of the first flared tongue 34C may be dimensioned to extend away from the shell contact surface 35 a distance beyond an exterior surface 42 of the first shell 14 in order to enhance friction of the rigid exterior case 12. The first flared tongues 34A–34D may also be dimensioned to be non-linear, as best shown in FIG. 2, and the first tongue slots 36A–36D may also be non-linear, as shown best in FIG. 2, in order to further enhance friction of the rigid exterior case 12 against a linear movement upon a flat surface. The first tongue slots 36A, 36B, 36C, 36D may be defined within a corresponding first friction groove 37 and second friction groove 39 defined within the exterior or contact surface 42 of the first shell 14 (shown best in FIGS. 2 and 3), so that the friction grooves 37, 39 also enhance overall friction and handling facility of the exterior surface 42 of the first shell 14.

If the flared tongues 34A–34D were linear, it would be possible for an unintended sliding force that is parallel to linear axes of the flared tongues to act upon the rigid exterior case 12, thereby minimizing a friction of the case 12 resisting the sliding force. By the first flared tongues 34A–34D (and other flared tongues described below) being non-linear, they cannot be aligned to minimize a friction of the case 12 against an unintended sliding force.

The resilient receiving insert 28 also defines a plurality of flexible receiving posts 44A, 44B, 44C, 44D, 44E, 44F, 44G, 44H that are dimensioned and positioned upon the first base 32 to adequately secure a memory device (not shown) within the resilient receiving insert 28. As best seen in FIG. 1 with respect to flexible receiving posts 44A, 44B, the posts 44A–44H may be in the shape of pyramid posts having narrow tips at points of furthest extension of the posts 44A–44H away from the first base 32 into the containment chamber 26, and having bottoms adjacent the first base 32 that are wider than the narrow tips so that the flexible receiving posts 44A–44H provide decreased flexure adjacent the first base 32 in order to enhance securing of the memory device adjacent the first base 32.

The memory device protective container 10 also includes a resilient securing insert 46 that is dimensioned to nest within the second shell 18, and that includes a second sealing peripheral lip 48 that surrounds the insert 46 and is positioned adjacent to the second peripheral edge 20 of the second shell 18 whenever the resilient securing insert 46 nests within the second shell 12. The resilient securing insert defines a second base 50 that extends between the second sealing peripheral lip 48, and a plurality of second flared tongues 52A, 52B, 52C, 52D extend from a shell contact surface 54. The second flared tongues 52A, 52B, 52C, 52D are dimensioned to pass through and be secured within (in the same manner as first flared tongue 34C) a plurality of second tongue slots 56A, 56B, 56C, 56D defined within the second shell 18. The second tongue slots 56A, 56B, 56C, 56D may be defined within a corresponding third friction groove 57 and a fourth friction groove 59 defined within an exterior surface 61 of the second shell 18, as best shown in FIG. 1

The resilient securing insert 46 also defines at least one securing rib 58, or may define a plurality of securing ribs or posts, such as the first securing rib 58 and a second securing rib 60. The securing ribs 58, 60 are dimensioned and positioned on the second base 50 to pass between the flexible receiving posts 44A–44H of the resilient receiving insert 28 in order to secure the memory device (not shown) against movement within the containment chamber 26 defined between the resilient receiving insert 28 and the resilient securing insert 46 whenever the first and second peripheral edges 16, 20 of the first and second shells 14, 18 are positioned adjacent each other.

The resilient receiving insert 28 may also define at least one support ridge, such as a first support ridge 62, or a second support ridge 64, or both, between the flexible receiving posts 44A–44H and extending from the first base 32 into the containment chamber 26. The support ridges 62, 64 are dimensioned to contact any memory device (not shown) secured by the receiving posts 44A–44H so that the memory device is restricted from smooth surface contact with the first base 32 of the resilient receiving insert 28. By so restricting such smooth surface contact between the memory device and the base 32 of the insert 28, any possible contamination by moisture or a foreign object is minimized.

Because the memory device (not shown) would be supported by the support ridges 62, 64 out of contact with the base 32, any liquid (not shown) inadvertently within the containment chamber 26 would not form a film between smooth surfaces of the memory device (not shown) and the base 32. Since no liquid film would be formed, the probability of contamination of the memory device (not shown) by the liquid is minimized. Similarly, if a small particle of foreign material (not shown), such as a sand particle, etc., were to be lodged within the containment chamber 26 on the base 32, securing the memory device within the resilient receiving insert 28 above the base 32 would not force the memory device (not shown) into an abrading contact with the particle, thereby further protecting the memory device (not shown). It is stressed that data transfer ports of modern, small memory devices are especially susceptible to damage by exposure to liquids, or by abrading contact with hard particulate foreign matter. Additionally, because the support ridges 62, 64 raise the memory device out of smooth surface, or intimate contact with the base 32 of the resilient receiving insert 28, extraction of the memory device (not shown) by fingers of a user (not shown) of the memory device protective container 10 is facilitated.

The first sealing peripheral lip 30 of the resilient receiving insert 28 and the second sealing peripheral lip 48 of the resilient securing insert 46 may be cooperatively dimensioned to contact and compress against each other to form a fluid seal restricting fluid movement into or out of the containment chamber 26 whenever the securing means secures the first peripheral edge 16 adjacent to the second peripheral edge 20. By providing a fluid seal in the described manner, much like a traditional "O-ring", the memory device protective container 10 provides a protection for a memory device stored within the containment chamber 26 against accidental contamination by spilled liquid, such as water or beverages, as well as against toxic gaseous substances, such as alcohol, volatile hydrocarbons, etc.

The rigid exterior case 12 is fabricated of any ordinary, non-deformable material that provides adequate protection of traditional hard memory storage devices such as diskettes, memory cards, etc., against impact damage by a foreign object falling upon the case 12, or, for example, by an accidental impact of a user's storage pocket, such as in a pants pocket against a hard object, such as a desk corner. Such non-deformable materials may include hard plastics, metals, wood, and other non-elastic materials, etc. A preferred material is polypropylene. The resilient receiving insert 28 and the resilient securing insert 46 are manufactured of any deformable material, such as soft, elastic or rubbery material known in the art to cushion magnetic storage devices against a shock of accidental impact. A preferred material for the resilient securing insert 28 is thermoplastic rubber, such as "SANTOPRENE" brand name thermoplastic rubber manufactured by the Advanced Elastomer Systems, Co. of Akron Ohio, U.S.A.

It is pointed out that the plurality of flexible receiving post 44A–44H may be dimensioned and positioned on the first base 32 to secure a variety of small memory devices of different dimensions. Because the resilient receiving insert 28 may be replaced to receive memory devices having differing dimensions, it is apparent that the memory device protective container 10 may be efficiently used for different size memory devices by only altering the dimensions of one of four major components; namely by only altering the resilient receiving insert 28, while the first and second shells 14, 18 and the resilient securing insert 46 remain the same for differing memory devices.

As is apparent, the rigid exterior case 12 provides durability to the memory device protective container 10 and also provides a firm structure to support the soft, rubber-like resilient receiving and securing inserts 28, 46 so that the memory device (not shown) is protected against any damage resulting from an impact upon the rigid exterior case. The compressed first and second sealing peripheral lips 30, 48 add further protection for the memory device, by providing a tight fluid seal around the containment chamber 26. Additionally, the contact head 38 of one of the first flared tongues 34C as well as contact heads of the other flared tongues 34A, 34B, 34D, 52A, 52B, 52C, 52D provide soft, rubber-like, friction enhancing surfaces on the first and second shells 14, 18 to substantially decrease a risk of accidental dropping of the container 10 by a person handling the container 10 by hand, or by slipping from a storage or use shelf or desk top. By integration of the two soft inserts 28, 46 with the two hard shells 14, 18, the memory device protective container 10 provides an elegant and secure container 10 for storage and transport of delicate, valuable memory devices (not shown).

While the present invention has been described and illustrated with respect to a particular construction of a memory device protective container 10, it will be understood by those skilled in the art that the present invention is not limited to the above described examples and embodiments. For example, while the described embodiment shows the resilient receiving insert 28 having eight receiving posts 44A–44H, it is within the scope of the invention to have as few as one receiving post or as many as would adequately secure a memory device against movement in cooperation with the opposed resilient securing insert 46. Further, while the receiving posts are shown as post-like structures in FIG. 1 disposed to contact adjacent edges at corners of a memory device (not shown), it to be understood that the receiving posts 44A–44H may be non-post-like structures, such as a plurality of "L-shaped" protrusions that overlie an entire corner, or one protrusion that is dimensioned to overlie and secure an entire, or most of a peripheral edge of a memory device. Additionally, while the illustrated first and second securing ribs 58, 60 of the resilient securing insert 46 are shown as elongate structures, it is likewise within the scope of the invention that the securing ribs 58, 60 may be any shape that will adequately secure a memory device, such as a post-like or circular shape, etc. Also, the resilient securing insert 46 may only include one securing rib in the form of a protrusion dimensioned to contact a memory device (not shown) secured within the resilient receiving insert 28 whenever the first and second shells 14, 18 are closed. Accordingly, reference should be made primarily to the attached claims rather than to the foregoing specification to determine the scope of the invention.

What is claimed is:

1. A memory device protective container for containing and protecting a memory device, comprising:

a. a rigid exterior case having a first shell that defines a first peripheral edge, having a second shell that defines a second peripheral edge, and having a securing means for securing the first and second peripheral edges adjacent each other to define a containment chamber between the first and second shells;

b. a resilient receiving insert dimensioned to nest within the first shell, the resilient receiving insert defining a first sealing peripheral lip that is positioned adjacent to the first peripheral edge of the first shell whenever the resilient receiving insert nests within the first shell, defining a first base extending between the first sealing peripheral lip, the first base having a shell contact surface that contacts the first shell, the resilient receiving insert also defining at least one flexible receiving post extending from a side of the first base opposed to the shell contact surface into the containment chanter, the flexible receiving post being positioned to receive and secure the memory device, and the resilient receiving insert also defining at least one support ridge extending from the base into the containment chamber to restrict smooth surface contact between the memory device and the first base of the resilient receiving insert; and, c. a resilient securing insert dimensioned to nest within the second shell, the resilient securing insert defining a second sealing peripheral lip that is positioned adjacent to the second peripheral edge of the second shell whenever the resilient securing insert nests within the second shell, defining a second base extending between the second sealing peripheral lip, the second base including a shell contact surface that contacts the second shell, and the resilient securing insert also defining at least one securing rib extending from a side of the second base opposed to the shell contact surface into the containment chamber between the inserts, the securing rib being positioned and dimensioned to contact the memory device to secure the memory device against movement within the containment chamber whenever the first and second peripheral edges of the first and second shells are positioned adjacent each other.

2. The memory device protective container of claim 1, wherein the first sealing peripheral lip and second sealing peripheral lip are cooperatively dimensioned to contact and compress against each other to form a fluid seal restricting fluid movement into or out of the containment chamber whenever the securing means secures the first and second peripheral edges of the first and second shells adjacent each other.

3. The memory device protective container of claim 1, wherein the resilient receiving insert includes at least one first flared tongue extending away from the shell contact surface of the first base and that is dimensioned to pass through and be secured by a first tongue slot defined within the first shell and wherein the first flared tongue has a contact head that extends away from the shell contact surface of the first base a distance beyond an exterior surface of the first shell, and wherein the resilient securing insert includes at least one second flared tongue extending from the shell contact surface of the second base and that is dimensioned to pass through and be secured by a second tongue slot defined within the second shell and wherein the second flared tongue has a contact head that extends away from the shell contact surface of the second base a distance beyond an exterior surface of the second shell.

4. The memory device protective container of claim 3, wherein the at least one first flared tongue of the resilient receiving insert and the at least one second flared tongue of the resilient securing insert are non-linear, and the first and second tongue slots defined within the first and second shells are non-linear to enhance friction of the first and second shells.

5. The memory device protective container of claim 4, wherein the resilient receiving insert and the first shell further comprise a plurality of non-linear first flared tongues and first tongue slots, and the resilient securing insert and second shell also comprise a plurality of non-linear second flared tongues and second tongue slots to enhance friction of the first and second shells.

6. The memory device protective carrier of claim 5, wherein the first tongue slots are defined within one or more friction slots defined within an exterior surface of the first shell, and the second tongue slots are defined within one or more friction slots defined within an exterior surface of the second shell to enhance friction of the first and second shells.

7. The memory device protective container of claim 1, wherein the securing means comprises a hinge secured between the first and second shell, and a latch that secures the first and second shells adjacent each other.

8. The memory device protective container of claim 1, wherein the at least one flexible receiving post comprises a pyramid post having a narrow tip at a point of furthest extension of the post into the containment chamber and having a bottom adjacent the first base that is wider than the narrow tip so that the flexible receiving post provides decreased flexure adjacent the first base to enhance securing of the memory device adjacent the first base.

9. The memory device protective container of claim 1, wherein the rigid exterior case is made of a non-deformable polypropylene material, and the resilient receiving insert and resilient securing insert are made of a deformable thermoplastic rubber material.

10. A memory device protective container for containing and protecting a memory device, comprising;

a. a rigid exterior case having a first shell that defines a first peripheral edge, having a second shell that defines a second peripheral edge, and having a securing means for securing the first and second peripheral edges adjacent each other to define a containment chamber between the first and second shells;

b. a resilient receiving insert dimensioned to nest within the first shell, the resilient receiving insert defining a first sealing peripheral lip that is positioned adjacent to the first peripheral edge of the first shell whenever the resilient receiving insert nests within the first shell, defining a first base extending between the first sealing peripheral lip, the first base having a shell contact surface that contacts the first shell, and the resilient receiving insert also defining a plurality of flexible receiving posts extending from a side of the first base opposed to the shell contact surface into the containment Chamber, the flexible receiving posts being positioned to receive and secure the memory device; and, c. a resilient securing insert dimensioned to nest within the second shell, the resilient securing insert defining a second sealing peripheral lip that is positioned adjacent to the second peripheral edge of the second shell whenever the resilient securing insert nests within the second shell, defining a second base extending between the second sealing peripheral up, the second base including a shell contact surface that contacts the second shell, and the resilient securing insert also defining at least one securing rib extending from a side of the second base opposed to the shell contact surface into the containment chamber between the inserts, the securing rib being positioned and dimensioned to pass between the flexible receiving posts of the resilient receiving insert to secure the memory device against movement within the containment chamber whenever the first and second peripheral edges of the first and second shells are positioned adjacent each other.

11. The memory device protective container of claim 10, wherein the first sealing peripheral lip and second sealing peripheral lip are cooperatively dimensioned to contact and compress against each other to form a fluid seal restricting fluid movement into or out of the containment chamber whenever the securing means secures the first and second peripheral edges of the first and second shells adjacent each other.

12. The memory device protective container of claim 11, wherein the resilient receiving insert includes a plurality of first flared tongues extending away from the shell contact surface of the first base and that are dimensioned to pass through and be secured by a plurality of first tongue slots defined within the first shell and wherein the first flared tongues have contact heads that extend away from the shell contact surface of the first base a distance beyond an exterior surface of the first shell, and wherein the resilient securing insert includes a plurality of second flared tongues extending from the shell contact surface of the second base and that are dimensioned to pass through and be secured by a plurality of second tongue slots defined within the second shell and wherein the second flared tongues have contact heads that extend away from the shell contact surface of the second base a distance beyond an exterior surface of the second shell.

13. The memory device protective container of claim 12, wherein the resilient receiving insert further comprises at least one support ridge extending from the base into the containment chamber to restrict smooth surface contact between the memory device and the first base of the resilient receiving insert.

14. The memory device protective container of claim 13, wherein the plurality of first flared tongues of the resilient receiving insert and the plurality of second flared tongues of the resilient securing insert are non-linear, and the first and second tongue slots defined within the first and second shells are non-linear to enhance friction of the first and second shells.

15. The memory device protective container of claim 14, wherein the first tongue slots are defined within one or more friction slots defined within an exterior surface of the first shell, and the second tongue slots are defined within one or more friction slots defined within an exterior surface of the second shell to enhance friction of the first and second shells.

* * * * *